United States Patent [19]

Chapman

[11] 3,974,383

[45] Aug. 10, 1976

[54] MISSILE TRACKING AND GUIDANCE SYSTEM

[75] Inventor: Arthur S. Chapman, Rolling Hills, Calif.

[73] Assignee: Hughes Aircraft Company, Culver City, Calif.

[22] Filed: Feb. 3, 1975

[21] Appl. No.: 546,471

[52] U.S. Cl. ..... 250/342; 244/3.11; 250/347

[51] Int. Cl.[2] ..... G01J 1/00

[58] Field of Search ..... 250/334, 347, 342; 244/3.11

[56] References Cited

UNITED STATES PATENTS 3,067,330 12/1962 Hammar ..... 250/347

*Primary Examiner*—Harold A. Dixon

*Attorney, Agent, or Firm*—Rafael A. Cardenas; William H. MacAllister

[57] ABSTRACT

A missile guidance system is disclosed which utilizes one optical system for visually tracking a target and directing a missile thereto by means of infrared (IR) energy emitted from the missile. The optical system includes a single objective lens for receiving both visible and infrared energy and directing those energies on a first prism. The first prism separates the visible energy from the infrared energy and directs the visible energy to an eyepiece for a viewer. A first image of infrared energy is directed to a first infrared sensor by a retrodirective reflector. A second image of infrared energy is directed at a second sensor by a rotating prism. The output signals from the first and second sensors are provided to missile control circuitry which compares these signals with reference signals and thereby generates command signals for steering the missile to the target.

14 Claims, 16 Drawing Figures

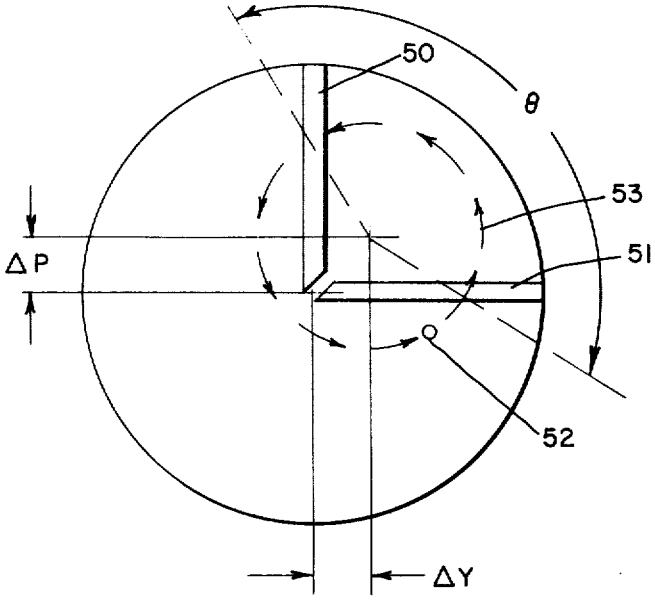
Fig. 5.
Fig. 6.
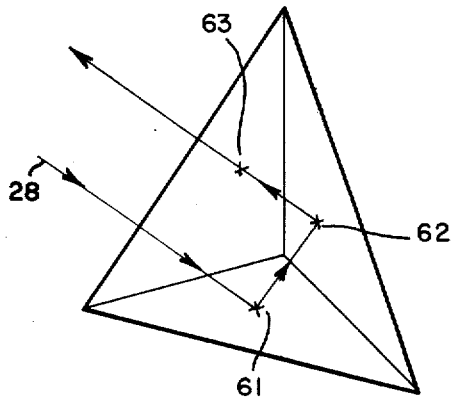
Fig. 7.
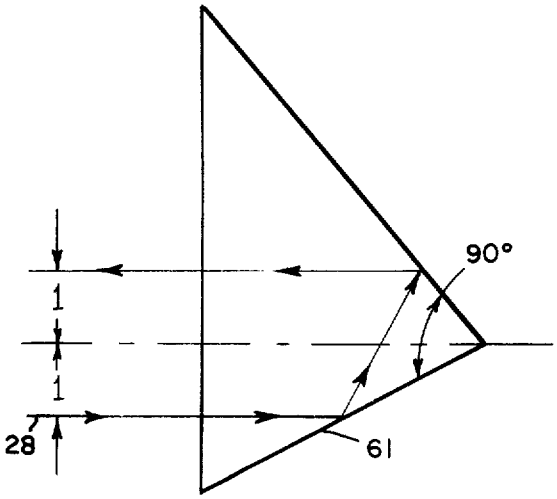

Fig. 12.
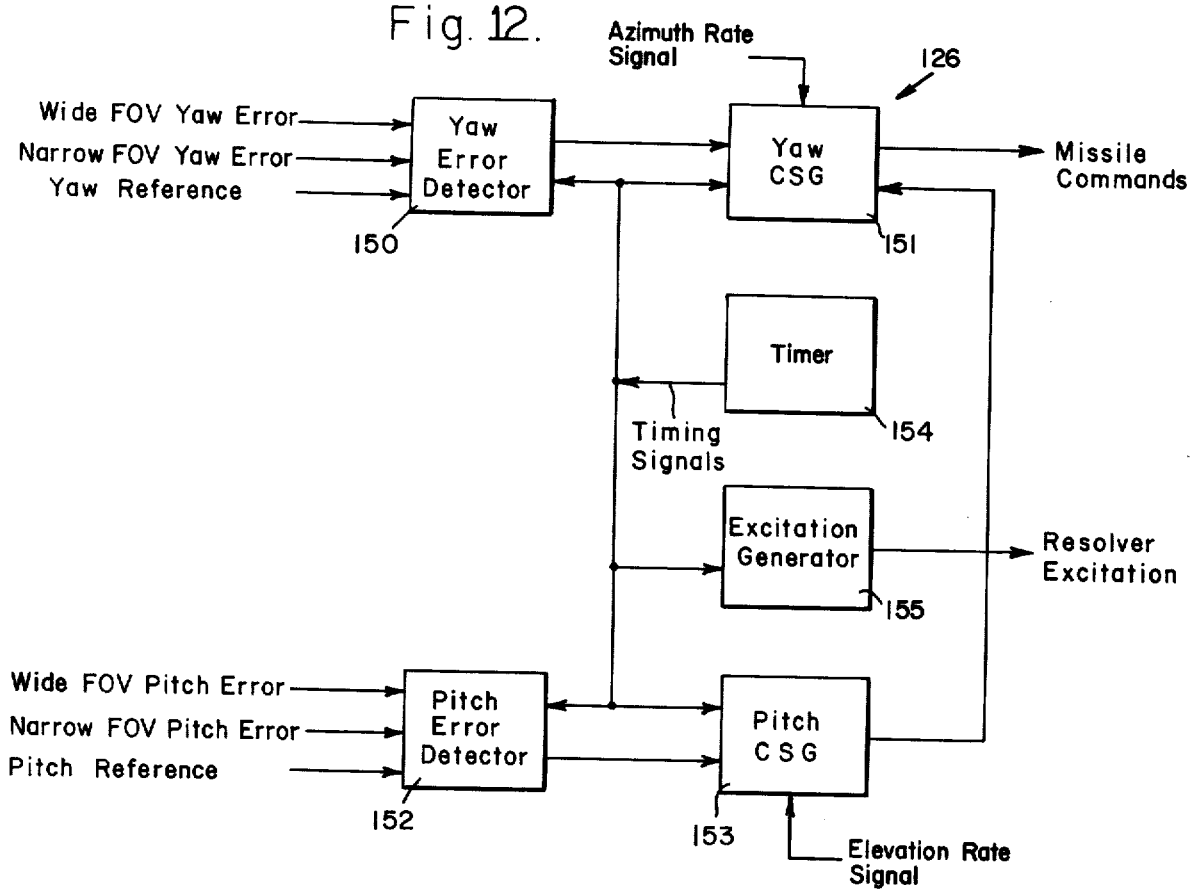
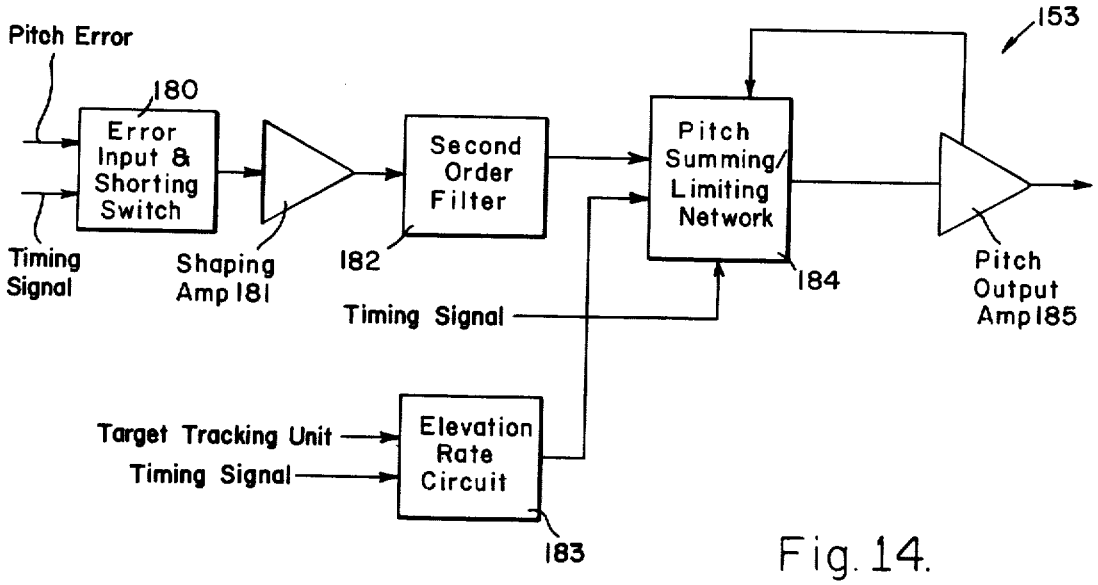
Fig. 14.

MISSILE TRACKING AND GUIDANCE SYSTEM

FIELD OF INVENTION

The invention relates generally to a missile guidance system. In particular, it relates to an optical sensor for generating error signals to guide a missile.

DESCRIPTION OF THE PRIOR ART

The remote guidance of a missile is well-known in the prior art as exemplified by U.S. Pat. No. 3,711,046 for "Automatic Missile Guidance System," Hamilton Barhydt, George T. Hahn and Spencer D. Howe, inventors. The guidance system according to the above-mentioned patent utilizes a first optical system for visually tracking a target and a second optical system, bore sighted to the first optical system, for tracking and guiding a missile by infrared energy emitted thereby. In such a system, generally, there is the problem of accurately bore sighting the visible optical system with the infrared optical system since the two system are separate. The problems of alignment are further aggravated by the rough handling that such equipment generally receives in the field.

A guidance system utilizing a first telescope for invention to telescope for tracking a missile by infrared signals and a second telescope for tracking a target by visible light energy is generally bulky, heavy and difficult to handle. A two telescope system is also more expensive since the optics must be duplicated.

SUMMARY OF THE INVENTION

Accordingly, it is an object of the present invention to provide a lightweight and reliable optical system for guiding a missile.

It is another object of the present invention to provide an optical system which eliminates the need for field boresighting.

It is still another object of the present invention to provide an optical system having a single objective lens for simultaneously tracking a missile and a target.

It is another object of the present invention to provide a novel method of nutating an image of a source of detector elements for generating error signals.

In accordance with the foregoing objects, an optical system according to the present invention includes lens means for receiving first and second waves and establishing a line-of-sight by the first wave. The second wave is directed to a rotating corner cube prism which reflects a first nutating image. The corner cube prism transmits a second image via a rotating prism which provides a second nutating image. The first and second nutating images are detected by first and second detectors which provide signals in response to said images.

BRIEF DESCRIPTION OF THE DRAWINGS

FIG. 5 is a characterization of the wide field of view detector with an off axis image of the source.

FIG. 6 is a perspective view of a generalized corner reflector.

FIG. 7 is an edge view of a corner reflector showing the relationship of an incoming ray, an outgoing ray, and the apex of the corner cube.

FIGS. 12 through 15 are block diagrams of electronic circuits that may utilize the signals provided by the wide and narrow FOV detectors 42 and 43, respectively, for guiding a missile.

Figure 1:
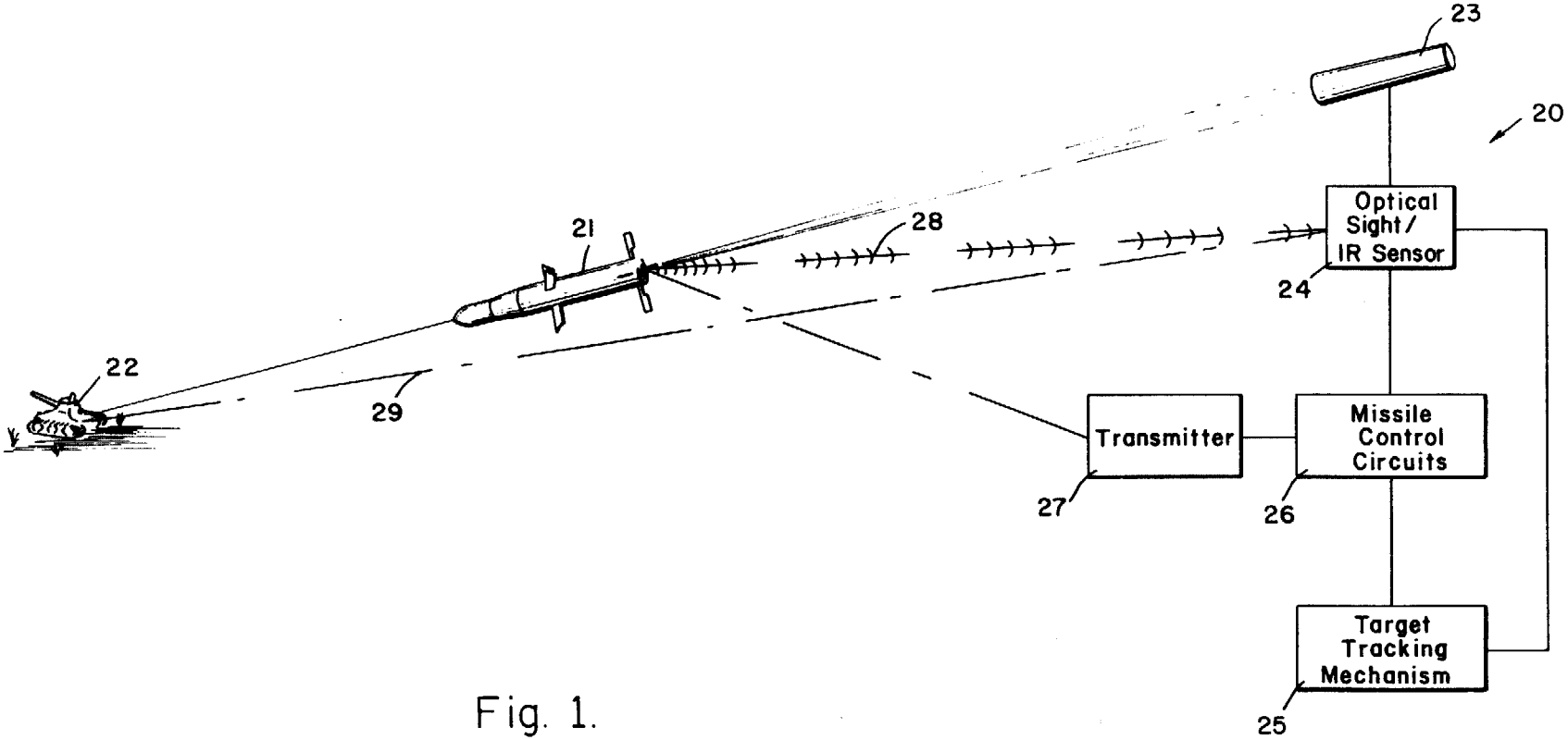
FIG. 1 is a pictorial and schematic block diagram of a missile system; utilizing the present invention.

Referring more specifically to FIG. 1, a missile guidane system 20 directs a self-propelled missile 21 at a target such as a tank 22. The missile 21 may have an infrared source, at the aft end, which generates a pulsed output signal.

The missile guidance system 20 includes a launch tube 23 which holds the missile and sets the initial trajectory when the missile 21 is fired. An optical sight/IR sensor 24 is mounted to the launch tube 23 and boresighted thereto. The optical sight 24 contains the optics for observing and visually tracking a selected target; and IR detectors for detecting the deviation of the IR path of the missile 21 from the visual line of sight. A target tracking mechanism 25 is physically and electrically connected to the optical sight/IR sensor 24 and generates azimuth and elevation reference signals from the position of the optical sight 24. The mechanism 25 generates azimuth reference signals which correspond to the azimuth of the optical sight 24. The mechanism also develops elevation reference signals which correspond to the elevation angle of the optical sight 24. The azimuth and elevation signals are supplied to the missile command generator 26. The missile command generator 26 is electronically connected to the optical sight 24 and contains voltage and pulse generating circuits, timing circuits and steering command circuits which control the missile flight to the target 22. A transmitter 27 transmits the commands from the missile command generator 26 to the missile 21. Alternatively, in wire guided type of missile systems transmitter 27 may consist of control wires connecting the missile command generator 26 to the missile 21.

In operation, the missile 21 is fired out of the launch tube 23 when the target 22 is within range. The optical sight 24 tracks the target 22 along the line of sight 29 and utilizes the reticle 34 as a sighting reference. The infrared energy source at the aft end of the missile 21 is tracked by the IR detectors in the optical sight 24 along the line 28. The optical sight 24 compares the instantaneous line-of-sight 28 to the missile with the instantaneous line-of-sight 29 to the target and establishes the amount of correction required by the missile 24 at any moment during the flight. The IR sensor (not shown) receives IR energy from the missile in flight and thereby establishes a reference line from the IR sensor to the missile. These signals, along with the reference signals for the target tracking mechanism 25, are applied to the missile command signal generator 26 for generating direction commands. The direction commands are transmitted to the missile 21 by the transmitter 27.

Figure 2:
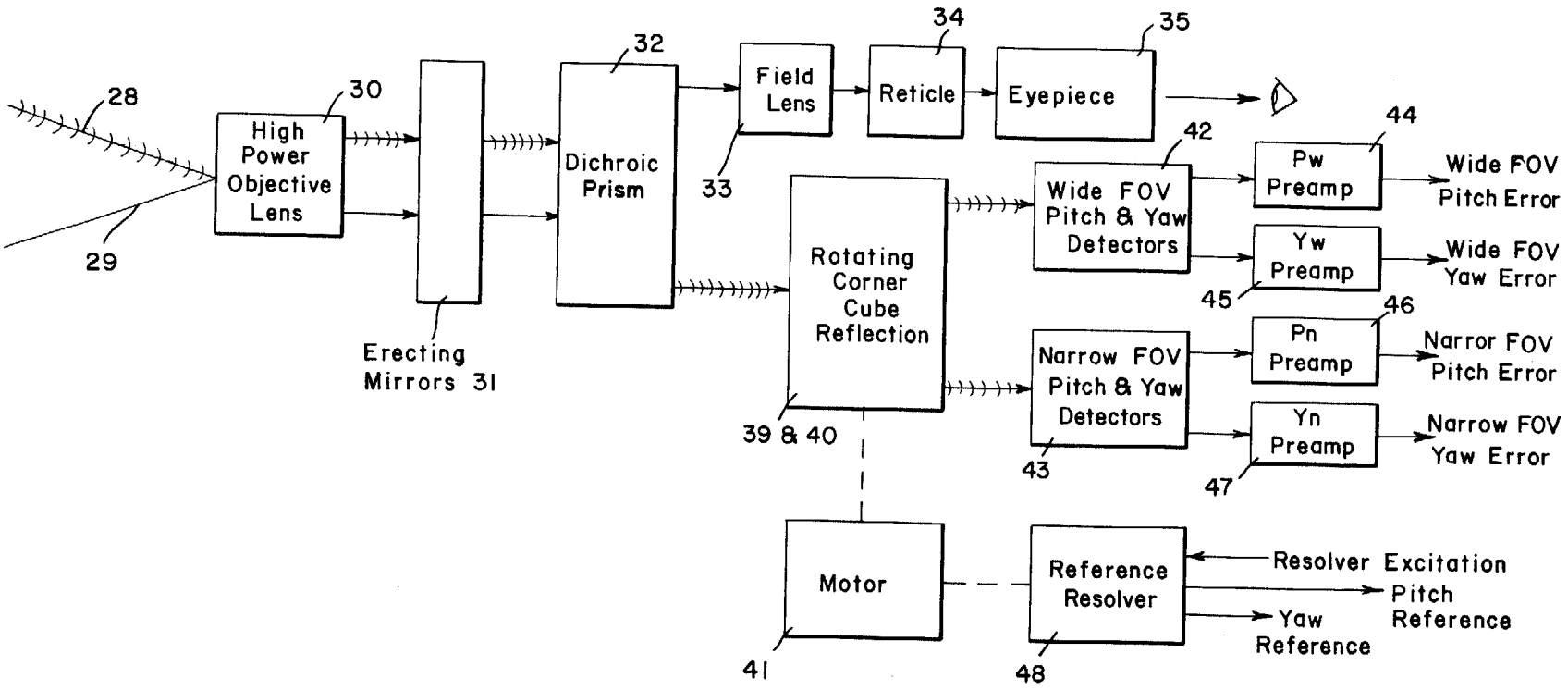
FIG. 2 is a schematic block diagram of an optical sight and IR sensor.
Figure 3:
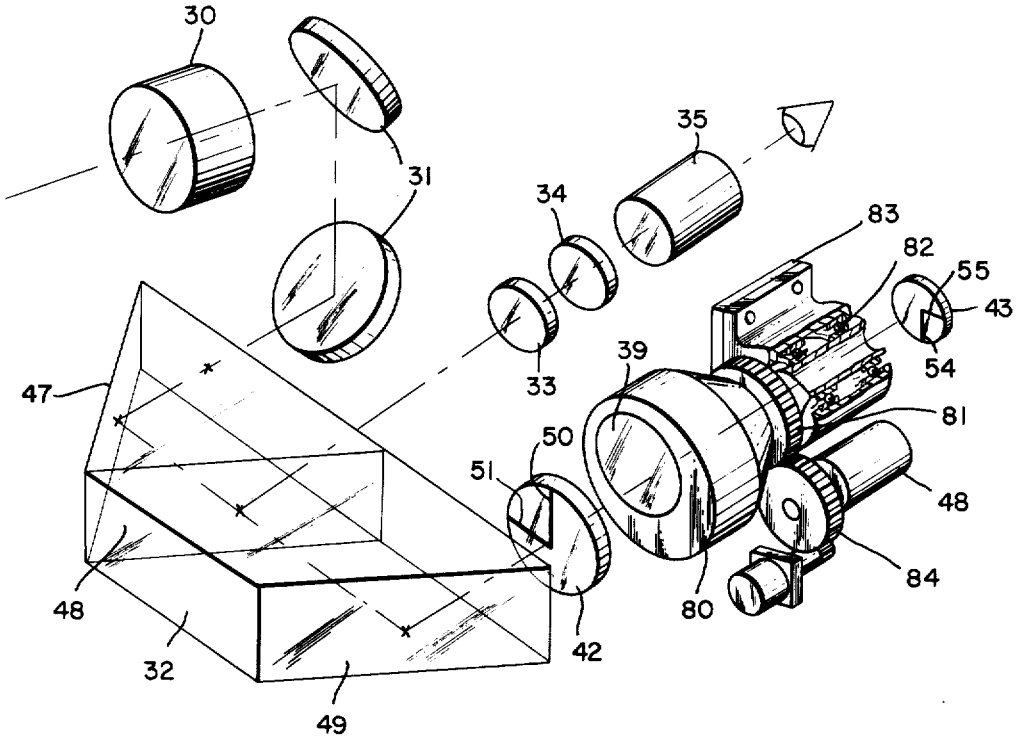
FIG. 3 is a perspective view of an optical sight and IR sensor depicted in FIG. 1.

Referring now to FIGS. 2 and 3, the optical sight/IR sensor 24 includes a high-power such as a triplet objective lens 30 for visibly tracking a target along a line of sight 29 (LOS 29). The objective lens 30 also receives the IR energy 28 from the missile 21. Both the IR energy and visible image are passed to erecting mirrors 31, which in turn reflect the energies to a dichroic prism 32. The visible image is reflected by the dichroic prism 32 to a field lens 33, a reticle 34 and an eyepiece 35. The optical system may provide a 13-power magnification and a field of view (FOV) of 5 for tracking selected targets, for example.

The dichroic prism 32 contains three reflecting surfaces 47, 48, 49. The surface 47 reflects both visual and infrared energy. The surface 48 is a dichroic mirror which reflects visible energy while it transmits infrared energy. The surface 49 reflects only infrared energy. The visible energy from the objective lens is reflected by the first and second reflecting surfaces 47 and 48 to the field lens 33, the reticle 34 and the eyepiece 35. Elements 33 and 34 act as additional means for erecting the visible image from the objective lens 30. The infrared energy from the objective lens 30 is reflected by the surface 47, passes through the surface 48 and is reflected by the surface 49 toward the rotating corner cube prism assembly 39 and 80 which is discussed in greater detail below.

The rotating prism 39 receives the infrared energy from the reflector surface 49. The prism 39 reflects a portion of the infrared energy back to the wide (FOV) pitch and yaw detectors 42 and the remaining IR energy is transmitted to the narrow (FOV) detectors 43. The reflected image nutates off the axis of the detectors 42 in proportion to the angular displacement of the missile source from the line of sight of the visible wave. In other words, if the missile 21 is following a trajectory that coincides with line-of-sight to the target 22, the IR image reflected by the assembly 30 nutates about the apex of the detectors 42. But if the missile 21 deviates from the aforementioned line-of-sight trajectory to the target 22, the IR image will nutate off the apex of the detectors 42.

A portion of the IR energy entering the rotating prism assembly is transmitted to the narrow (FOV) detectors 43 and forms a second nutating image thereon. The second IR image nutates off the axis of the detectors 43 in proportion to the angular displacement of the missile source from the LOS of the visible wave similar to the nutation of the first IR image on the wide (FOV) detectors 42.

The wide (FOV) detector 42 is connected to the wide pitch preamplifier 44 and to the wide yaw preamplifier 45. The narrow (FOV) detector 43 is coupled to the narrow pitch preamplifier 46 and to the yaw yar preamplifier 47. The preamplifiers 44-47 are in turn coupled to the missile command signal generator 26.

The prism 39 is rotatably driven at 1200 RPM by a motor such as a 125 vac, 400 Hz electric motor 41. The motor 41 is also used to drive a reference resolver 48 having two secondary windings (not shown) which rotate around a d-c excited stator (not shown). The windings are physically positioned 90 degrees out of phase with one another. One winding has a zero reference in pitch and the other has a zero reference in yaw. The secondary windings are coupled to the missile command signal generator 26 and provide the pitch and yaw reference signals. The reference resolver 44 generates electrical reference signals which are representative of the pitch and yaw planes between the optical sight and the target 22. The reference signals are utilized in conjunction with signals from the IR sensor to determine the magnitude and direction of guidance correction signals required to direct the missile 21 to the target 22.

The corner cube prism 39 is now described in greater detail. The support member 80, is a funnel-shaped metal casting having an eccentric opening at one end of the funnel for holding the corner cube prism 39. The prism 39 is positioned in the eccentric opening of the member 80 such that the principal optical axis of the prism 39 is concentric with the axis of rotation of the support member 80. Also the axis of symmetry of the prism 39 is parallel to the axis of rotation of the member 80. A gear member 81 is mounted to the member 80 for rotating the prism 39. The member 80 is supported in place by a bearing member 82 and a fixed support member 83. A drive gear 84 engages the gear 81 and is driven by a motor 41. As mentioned above, the motor 41 also drives a resolver 48. The wide FOV detector 42 is oriented facing the flat surface of the corner cube prism 39. The narrow FOV detector 43 is located at the narrow end of the support member 80.

Figure 4A:
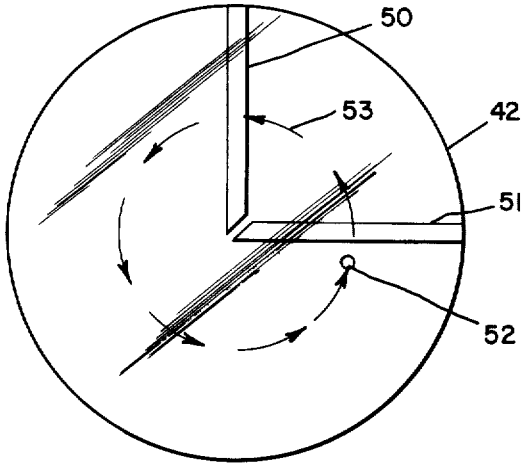
FIGS. 4*a* and 4*b* are characterizations of the orientation of the detector arms, the image of the source and the locus of the image motion.
Figure 4B:
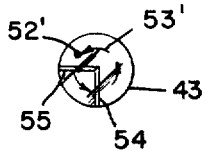

Referring now to FIGS. **4*a* and 4*b*, the orientation of the wide and narrow FOV detectors, 42 and 43 respectively, is illustrated. The wide FOV pitch and yaw detectors 42 are two arm-like IR detectors, 50 and 51, oriented 90° to each other. The length of each arm determines the field of view of the particular optical system. The detectors referred to herein are commonly known as L-type orthogonal detectors. The IR detectors 50 and 51 provide an output signal each time the IR image 52 of the missle 21 sweeps across either the pitch 50 or yaw 51 detector. By measuring the time between signals produced by the nutating image 52 (whose locus 53 is a circle of a diameter equal to the detector arm length for all source positions) and knowing the angle $\phi$ traversed by the prism (measured by resolver 48) the error from the desired line-of-sight may be computed. The orientation of the narrow FOV detectors 43 is such that the pitch and yaw detectors are rotated 180° from the wide FOV detectors 42. This requirement exists because the corner cube prism 39 inverts and reverts the image, a condition that does not exist for the narrow FOV detector 43. FIGS. 4*a* and 4*b* depict a condition of zero error between the missile source and the L.O.S. 28. The infrared detectors 50 and 51** are of the conventional L-type orthogonal detectors which are described in "Infrared System Engineering" by Richard D. Hudson, Jr., John Wiley and Sons, Inc., 1969, pages 235–263 and in particular, pages 255–256.

Referring now to FIG. 5, an error condition is illustrated between the image 52 of the missile source 21 and the LOS 28 which is equal to $\Delta P$ ($\Delta$ pitch) and $\Delta Y$ ($\Delta$ yaw). The locus of the image 52 is still a circle whose diameter is equal to the length of the detector arm 50 or 51. The center of the locus is offset by $\Delta P$ and $\Delta Y$ from the apex of the detector 42. By measuring the crossing time and knowing the angle $\phi$ an error can be computed between the LOS 28 and the missile 21 as previously mentioned. In a similar manner, the error signal is computed from the narrow FOV detctor 43.

FIGS. 6 and 7 illustrate the well known property of a retrodirective corner reflector. An incoming light ray 28 is reflected off of surfaces 61, 62, and 63, successively and returned parallel to 28. FIG. 7 illustrates a special orientation of the reflector such that the ray is reflected off surface 61 and the ridge formed by the intersection of the surfaces 62 and 63. This allows a two dimensional representation of the three dimensional reflection. FIG. 7 shows an edge of plane 61 and a line representing the intersection of planes 62 and 63. FIG. 7 further indicates that a ray entering a unit distance below the apex of the corner reflector exits a unit distance above the apex of the corner reflector; the entering and exiting rays, and the apex all being in the same plane. The orientation shown, while a special case to simplify mathematical proof, in no way alters the criteria that the exiting ray be parallel to the incoming ray. The ray may be visualized as being reflected off of surface 62 an infinitesimal distance from surface 63 such that when viewed from this special orientation the two reflections appear to coincide.

Figure 8:
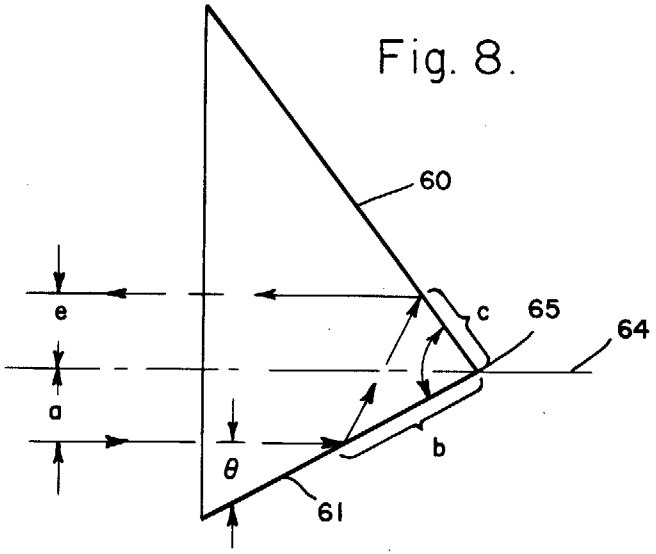
FIG. 8 is an edge view of a corner reflector which is used in the mathematical proof that incoming and exiting rays are equidistant from the apex of the corner reflector.

Referring now to FIG. 8, a unit value $a$ is assigned to the distance between an axis 64, parallel to the incoming ray 28, drawn through the apex 65 and the incoming ray 28. A unit value $e$ is assigned to the distance between the axis 64, and the outgoing ray 28. The preferred orientation of the retrodirective reflector 60 to an incoming ray 28 is such that the chief optical ray 28 is at an angle $\theta$ of 35.26° to the plane 61.

In FIG. 8: the distance $a = 1$, the distance $b = \csc\theta$, the distance $c = \csc\theta \tan\theta = \sec\theta$, and the distance $e = \sec\theta \sin(90 - \theta)$. Since $\sin(90-\theta) = \cos\theta$ and $\sec\theta = 1/\cos\theta$ then it is obvious that distance $e =$ $$\sec\theta \sin(90 - \theta) = \cos\theta/\cos\theta = 1 = \text{distance } a.$$

Thus it has been shown that a ray entering a corner reflector a distance $a$ from the apex will leave the corner reflector a distance $a$ from the opposite side of the apex and to the incoming ray.

It is obvious from the above that when the corner reflector is rotated about the incoming ray 28 with the apex a distance $= a$ from the axis of rotation that the exiting ray will describe a circle of radius $2a$ about the axis of rotation.

Since it is necessary that the corner cube prism 36 provide a displacement of the locus of the image 45 of the infrared source proportional to the displacement of the source from the LOS 29, proof of this statement will now be discussed.

Figure 9:
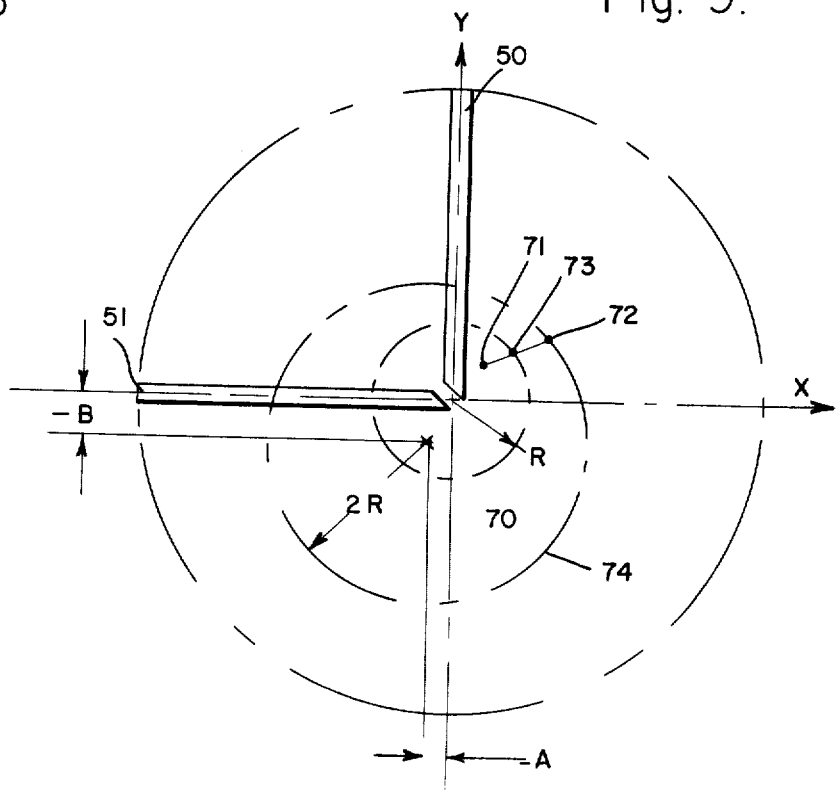
FIG. 9 is a view of the detector with an off axis image of the source, said view is used to clarify the mathematical proof of proportional deviation of the locus of the image of the source to the deviation of the line of sight.

FIG. 9 illustrates the cross section of the optical system taken at the plane of the detectors 42. A circle 70 drawn concentric with the center of the apex of the detectors 42 represents the locus of the apex of the corner cube prism 39 as it rotates about the apex of the detectors 50 and 51. A point 71 with coordinates A, B relative to coordinate system X, Y, — represents an end view of a single ray of infrared energy coming from the objective lens 30 and having just previously been reflected off of surface 35. A ray 71 represents the displaced line of sight (LOS) 28. Another point 72 is the image of the missile source having coordinates U, V relative to the coordinate system X, Y. Yet another point 73 having coordinates X, Y represents the apex of the corner cube prism (prism not shown) whose locus is 74 as it rotates about the apex of the detectors 38 with a radius equal to R. The equation of the locus 70 is then $$R^2 = X^2 + Y^2,$$

using the previously mentioned property that an incoming ray, offset from the apex of a corner cube prism by a fixed distance, is returned parallel to the incoming ray and offset the same fixed distance on the other side of the apex. (Thus, the three entities apex, incoming, and return rays are all in a single plane), and the distance from point 71 to point 73 is equal to the distance from point 73 to 72. The points 71, 72 and 73 are all in a straight line which represents an edge view of a plane containing the three entities 71, 22 and 73. Then;

$$[(X, Y) - (A, B)] + (X, Y) = (U, V)$$

simplifying $$(2X - A, 2Y - B) = U, V$$

$$2X - A = U$$

$$2Y - B = V$$

and $$2X = U + A$$

$$2Y = V + B$$

squaring both sides $$4X^2 = (U + A)^2$$

$$4Y^2 = (V + B)^2$$

adding the two equations $$4X^2 + 4Y^2 = (U + A)^2 + (V + B)^2$$

now since $$X^2 + Y^2 = r^2$$

then $$4X^2 + 4Y^2 = (2R)^2$$

Therefore $$2R^2 = (U + A)^2 + (V + B)^2$$

which is the equation of a circle with centers at —A, —B and radius 2R. Thus the circle has remained constant in diameter and has moved in an opposite sense proportional to the initial offset A, B. The coordinate system X, Y, was chosen to coincide with the line-of-sight 29 after leaving the objective lens 30.

Figure 10:
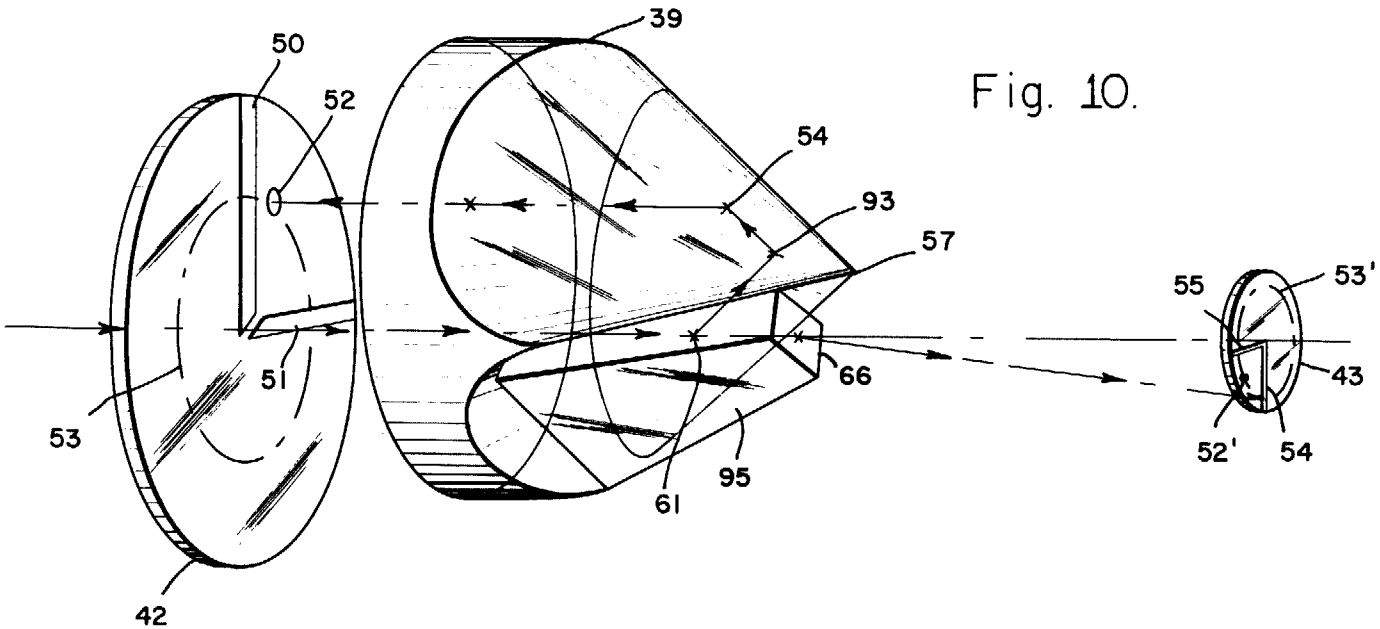
FIG. 10 is an illustration showing the corner cube prism and the wide and narrow field of view infrared detectors.

The operation of the corner cube prism 39 of FIG. 10 is now described. As previously discussed, the infrared energy 28 transmitted by the dichroic prism surface 48 passes through the transparent substrate (transparent to IR) of the wide FOV detector 42 and enters the prism 39. While a single ray is shown, those skilled in the art know that at the plane of the detector 42 substrate, the incoming energy is made up of a bundle of rays such that a cross-section through the rays would be a circle of substantial diameter which results in the detector arms 50 and 51 obscuring a portion of the energy. The bundle of rays converge to a near-point forming an image 52 of the missile source on the detector 42. The corner cube prism 39 must be of sufficient size such that the reflecting surface 61 intercepts all rays of the above-mentioned bundle which would converge on the narrow FOV detector 43. The IR energy is reflected by surfaces 61, 93 and 54 back to the wide FOV detector 42, which traces a locus 53 on the detector 42 as discussed above.

The dichroic or partially silvered mirror at the surface 61 between the corner cube prism 39 and the wedge prism 95 transmits a portion of the IR energy striking the surface 61. The IR energy passes through the surface 61 and exits through a canted surface 66, the rotation of which causes the image 52' to trace a circular locus 53' on the narrow FOV detector 43.

Figure 11:
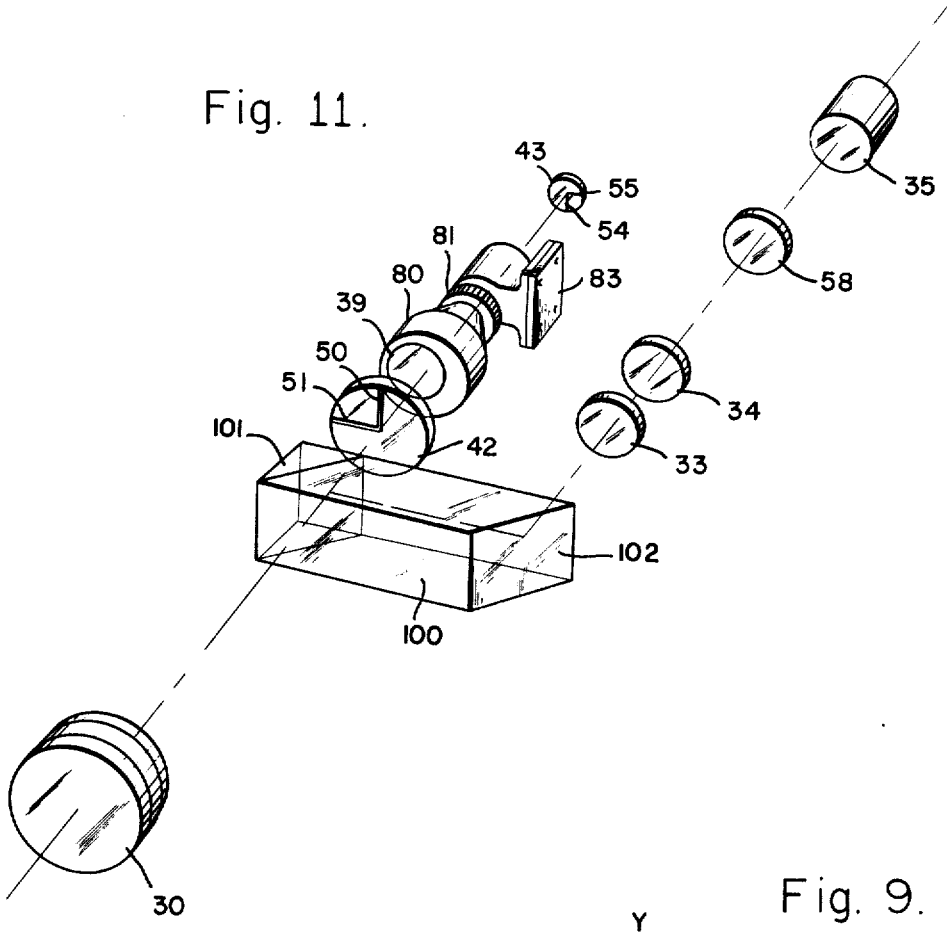
FIG. 11 is a variation of the configuration shown in FIG. 7 which utilizes a different means of erecting the image.

Referring to FIG. 11, another embodiment of the present invention is herein described. In this second embodiment, the dichroic prism 32 and the erection mirrors 31 have been replaced by a dichroic prism 100. The prism 100 has a dichroic mirror or surface 101 which transmits infrared energy to the rotating corner cube prism 39 and reflects visible energy. The reflecting surface 102 reflects the visible energy to a field lens, a reticle and an eyepiece similar to the optics of the embodiment to FIGS. 2 and 3. The operation of the second embodiment is similar to the operation of the first embodiment and will therefore not be described in greater detail.

FIGS. 12–15 are illustrative of the electronic circuits that may utilize the signals provided by the wide and narrow FOV detectors 42 and 43, respectively, for guiding a missile.

FIGS. 12–15 are included herein for purposes of illustrating a missile guidance system that may utilize the signal generated by the present invention.

Referring more specifically to FIG. 12, a missile command generator may be seen to include a yaw error detector 150 for receiving yaw error signals from the wide and narrow FOV detectors 42 and 43, respectively. The yaw error detector 150 also receives a yaw reference signal from the reference resolver 48 which signal is compared to either the wide or the narrow FOV yaw error signals. If the missile 21 flight path varies from the line of sight to the target, an output error signal is provided to the yaw command signal generator 151. The input terminals of a pitch error detector 152 are connected to the wide and narrow preamplifiers 44 and 46, respectively, and to the pitch reference terminal of the reference resolver 48. The pitch error detector 152 compares either the wide or narrow pitch error signals with the pitch reference signal and provides an error output signal to the pitch command signal generator (CSG) 153. A timer 154 is connected to the yaw error detector 150, the yaw CSG 151, the pitch error detector 152, the pitch CSG 153, and an excitation generator 155. The time 154 provides logic timing signals to the various circuits. The excitation generator 155 is connected to the reference resolver 48 and provides a programmed variable gain resolver excitation voltage for the reference resolver to generate pitch and yaw reference voltages. The output terminal of the pitch CSG 153 is connected to the yaw CSG 151, which in turn is connected to the transmitter 27.

The pitch CSG 153 is also connected to the elevation rate terminal of the target tracking mechanism 25. The elevation rate signal from the mechanism 25 is combined with the error signal from the pitch error detector 152 and a pitch command signal is developed thereby. A more detailed discussion of the pitch CSG 153 is found below.

The yaw CSG is connected to the azimuth rate terminal of the target tracking mechanism 25. The azimuth rate signal from the mechanism 25 is combined with the error signal from the yaw error detector 150 and a yaw command signal is developed. A more detailed discussion of the yaw CSG 150 is found below.

In operation, the timer 154 of FIG. 12 provides timing signals to the excitation generator 155. The excitation generator 155 in turn supplies a variable output signal to the reference resolver 48 which generates the yaw and pitch reference signals. The yaw error detector 150 compares the wide FOV yaw error signal from the preamplifier 45 during the first few seconds of missile flight in response to a timing signal from the timer 154. If the missile deviates from the line of sight to the target, an error signal is generated and supplied to the yaw CSG 151. The yaw CSG 151 combines the error signal from the yaw error detector 150 with the azimuth rate signal from the target tracking unit 25 and provides a command signal to the transmitter 27. After the first few seconds of missile flight, the yaw error detector 150 then compares the narrow FOV yaw error signal with the yaw reference signal and provides an error signal to the yaw CSG 151. The pitch error detector 152 and the pitch CSG 153 function in a manner similar to the yaw error detector 150 and the yaw CSG 151, and for that reason will not be discussed in detail.

Figure 13:
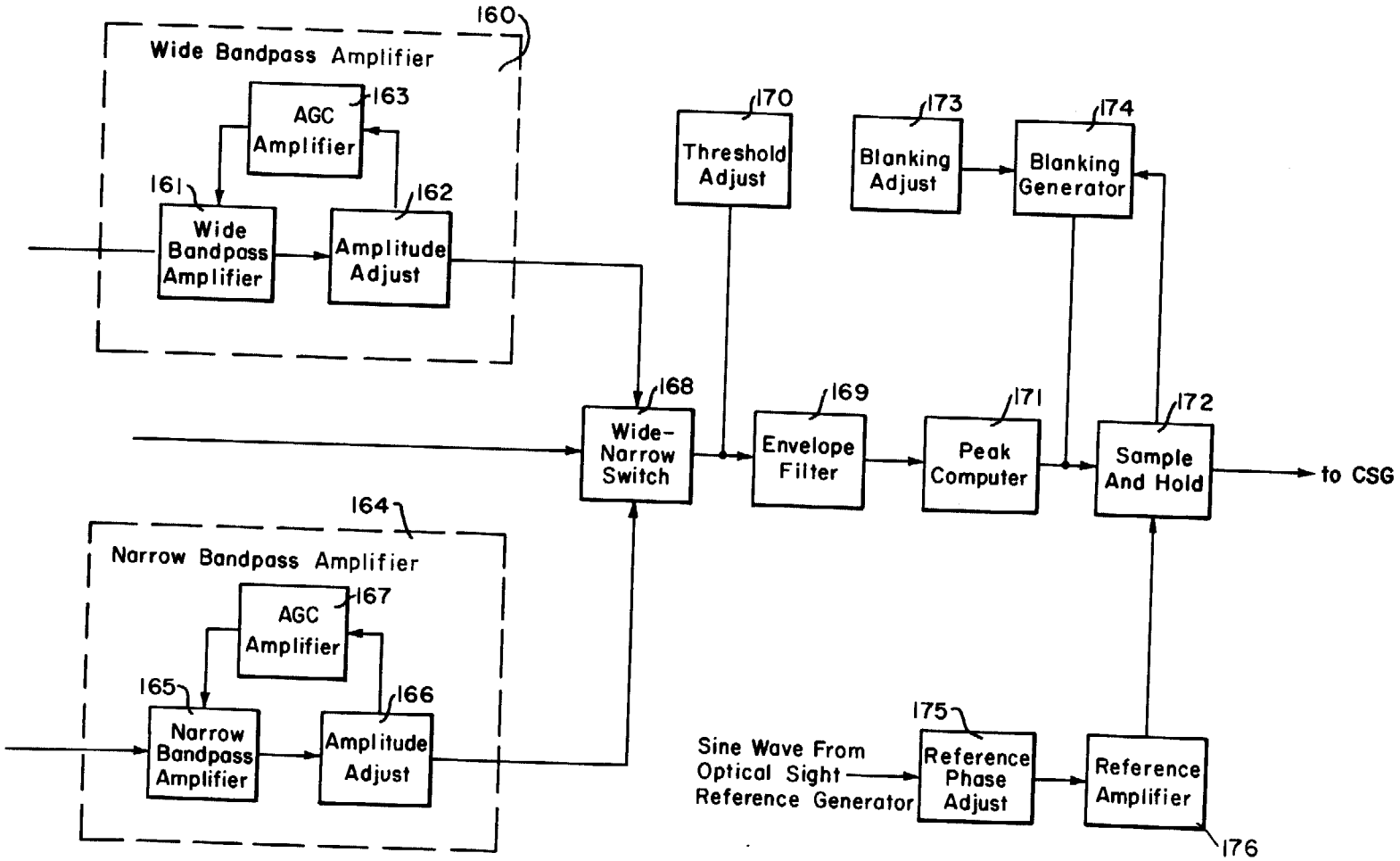

Referring now to FIG. 13, an error detector circuit is now discussed. Since both the yaw error detector 150 and the pitch error detector 152 are identical, only the yaw error detector is described. The error detector 150 includes a wide bandpass AGC amplifier 160 and a narrow bandpass AGC amplifier 164, whose respective output terminals are connected to a wide-narrow switch 168. The wide bandpass AGC amplifier 160 amplifies the signal from the wide field of view detector 42 and supplies that amplified signal to the wide-narrow switch 168. The narrow bandpass AGC amplifier 164 amplifies the signal from the narrow field of view detector 43 and supplies that output signal to the wide-narrow switch 168.

The third input terminal of the switch 168 is also connected to an output terminal of the timer 154. The switch 168 provides an output signal from either the amplifier 160 or the amplifier 164 in response to signals from the timer 154. As mentioned above, during the early phase of the missile flight, the timer 154 controls the switch 168 so that the output signal from the amplifier 160 is provided at the output terminal of the switch 168. During the later phase of flight the timer 154 provides a signal to the switch 168 so that the output signal of the amplifier 164 is provided at the output terminal of the switch 168. The wide bandpass AGC amplifier 160 includes a wide bandpass amplifier 161 connected to an amplitude adjust 162, which in turn is connected to an AGC amplifier 163. The amplifier 163 is connected to an input terminal of the wide bandpass amplifier 161, thereby forming an AGC loop. The output terminal of the wide bandpass amplifier 160 or the output terminal of the amplitude adjust 162 is connected to the input terminal of the wide-narrow switch 168. The input terminal to the wide bandpass AGC amplifier 160 is coupled to the output terminal of the wide FOV yaw preamplifier. The output signal from the amplifier 160 is in use during the period beginning with the missile launch (T = 0 sec.) until approximately T = 2 sec. The AGC amplifier 163 controls the gain of the wide bandpass amplifier 161 to insure that the amplitude of the signal pulse output remains constant even though the incoming signal intensity may vary greatly. The amplitude adjust 162 may be manually adjusted to provide the desired signal amplitude at the input terminal of the wide-narrow switch 168.

The narrow bandpass AGC amplifier 164 is similar to the wide bandpass AGC amplifier 160. The amplifier 164 includes a narrow bandpass amplifier 165 connected to an amplitude adjust 166 which in turn is connected to an AGC amplifier 167. The output of the amplifier 167 is connected to an input terminal of the narrow bandpass amplifier 165, thereby making a complete AGC loop. The output terminal of the narrow bandpass amplifier 164 on the output terminal of the amplitude adjust 166 is connected to the wide-narrow switch 168. The amplifier 160 and the amplifier 164 vary from one another in that the amplifier 160 has a very fast AGC attack time and a slow AGC decay time since the input signal amplitudes change from maximum to minimum in a short period of time. The amplifier 164 has a slower AGC attack time and a very slow AGC decay time since the input signal amplitudes change from maximum to minimum in a longer time period. A more detailed discussion of the function of a bandpass AGC amplifier will not be made since such amplifiers are well known in the art.

The output terminal of the switch 168 is connected to the input terminal of an envelope filter 169. A threshold adjust 170 is also connected to an input terminal of the envelope filter 169. The filter 169 provides an output envelope waveform of input signal having a threshold greater than a threshold that is set by the threshold adjust 170.

The source modulation of the input signal to the envelope detector 169 is removed to form the signal by the input filter (not shown) portion of the filter 168, thus only the signal envelope remains. The threshold portion of the filter 169 is biased by the threshold adjust 170 such that the demodulated signal voltage is passed only when it exceeds a minimum amplitude.

The output terminal of the envelope filter 169 is connected to the input terminal of a peak computer 171 which determines the peak voltage by taking the derivative of the envelope waveform.

The output terminal of the peak computer 171 is connected to one input terminal of the sample and hold circuit 172. One output terminal of the sample and hold circuit 172 is connected to a blanking generator 174 which in turn is connected to the first input terminal of the sample and hold circuit 172 thereby making a closed loop. A blanking adjust circuit 173 is connected to another input terminal of the blanking generator 174. A reference phase adjust circuit 175 receives a sine wave input signal from the reference resolver 48 which signal is the yaw reference signal. The reference voltage from the resolver 48 is an indication of the position of the rotating corner cube prism 39 which in turn indicates the relative position of the missile with respect to the line of sight of the target. The output terminal of the adjust circuit 175 is connected to the input terminal of a reference amplifier 176. The output signal from the peak computer 171 triggers the sample and hold circuit 174 which then measures the instantaneous value of the reference voltage from the reference amplifier 176. The blanking generator 174 serves to prevent spurious pulses from triggering the sample and hold circuitry 172 which spurious signals would result in erroneous steering signals. A 40 millisecond pulse is developed by the blanking generator 174 which shorts the peak computer 171 output immediately after the sampling period. The blanking time is adjustable by the blanking adjust circuit 173.

In operation, the circuit of FIG. 13, the wide bandpass AGC amplifier 160 provides an amplified signal from the wide FOV preamplifier to the wide-narrow switch 168. The narrow bandpass AGC amplifier 164 also provides a signal from the narrow FOV yaw preamplifier 47 to the wide-narrow switch 168. During the first appoximately two seconds of missile flight, the switch 168 provides the wide FOV signal to the envelope filter 169. During the subsequent flight time, the switch 168 provides the narrow FOV signal to the filter 169. The filter 169 removes the modulation from the input signal and provides an output signal of only the envelope of the waveform of the input signal to the peak computer 171. The peak computer 171 provides an output pulse to the sample and hold circuit 172 when the envelope signal from the filter 169 reaches a peak. The computer 171 output signal causes the sample and hold circuit 172 to sample the voltage from the reference amplifier 176 during a predetermined period of time and holds this value until the next sample period. The output pulse of the peak computer 171 initiates a predetermined sampling period such as 100 microseconds ($\mu$ sec.). The output voltage of the reference amplifier 176 is sampled during the sampling period and the voltage at the end of the period is held until the beginning of the next sampling period. The circuit 172 provides a push-pull output signal to the yaw command signal generator 151 which signal has a predetermined width and a d-c voltage which is indicative of steering error. The trailing edge of the output pulse from the sample and hold circuit 172 triggers the blanking generator which in turn shorts the input terminal of the circuit 172 to prevent spurious pulses from triggering the circuit 172.

It is pointed out that only the yaw error detector 150 is described because the pitch error detector 152 is identical to the detector 150.

Referring to FIG. 14, a pitch command signal generator 153 includes an error input and shorting switch 180 having a first input terminal for receiving an error signal from the pitch error detector and a second input terminal for receiving a signal from the timer 154. The shorting switch 180 shorts the error signal input to ground prior to missile launch to prevent stray noise transients from affecting missile operation before launch. At about T = 0.20 seconds, an unshort signal is applied to the switch 180 by the timer 154. The output of the switch 180 is connected to a shaping amplifier 181 which in turn is connected to a second order filter 182. The filter 182 removes all second and higher order harmonics from the input signal. The output terminal of the filter 182 is connected to an input terminal of the pitch summing and limiting network 184.

An elevation rate circuit 183 receives an elevation rate signal from the target tracking unit 25. A second input terminal of the circuit 183 provides an input terminal for a signal from the timer 154. The elevation rate signal from the target tracking unit 25 is shorted to ground prior to launch, at which time an unshort signal is supplied to the circuit 183 by the timer 154. The circuit 183 output terminal is connected to a second input terminal of the pitch summing and limiting network 184. A third input terminal of the pitch summing and limiting network 184 is connected to the timer 154, which provides a pitch limit drive signal. The pitch limit drive signal from the timer 154 limits the output of the network 184 to a predetermined voltage output level. The pitch summing and limiting network 184 combines the pitch error signal from the second order filter 182 and the elevation rate signal from the circuit 183 and provides an output signal to a pitch output amplifier 185. The amplifier 185 is connected also to the network 183 by a feedback loop. The output terminal of the amplifier 185 is connected to the yaw command signal generator 151.

Figure 15:
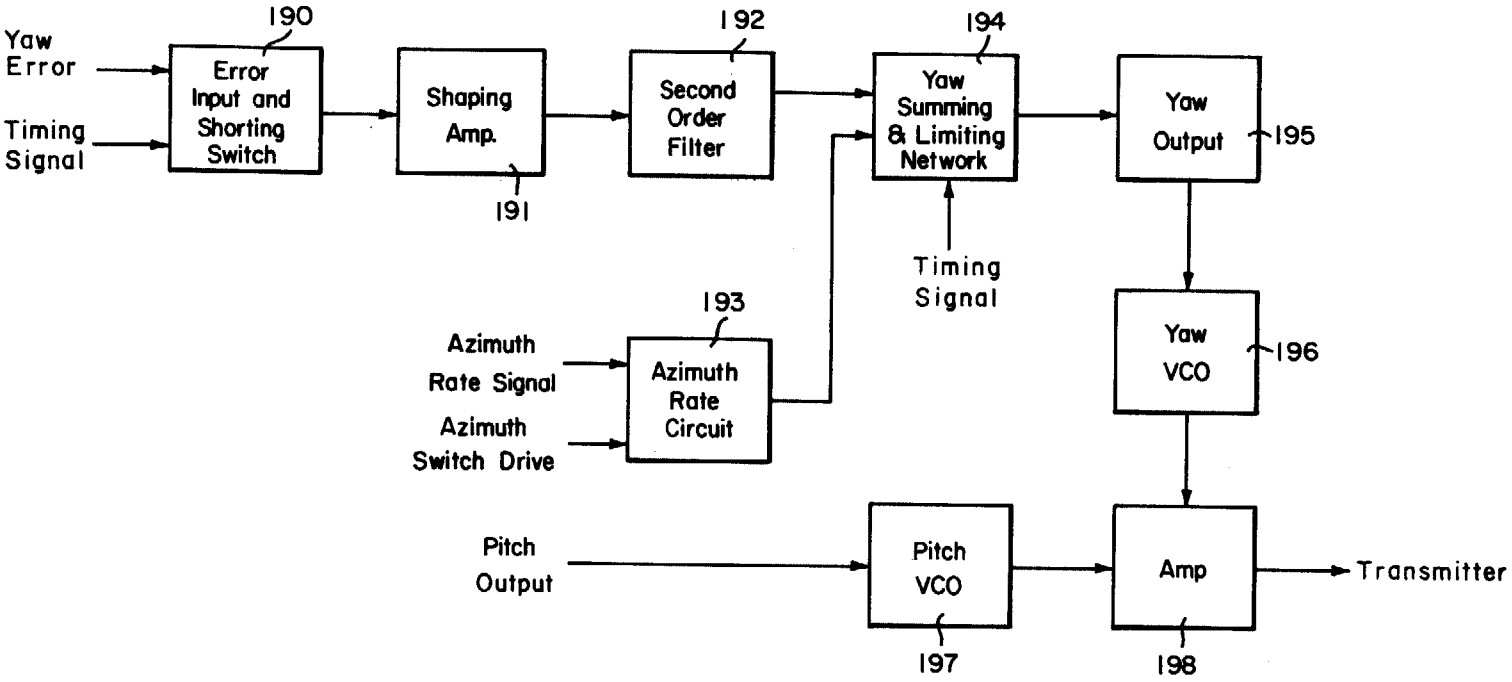

Referring now to FIG. 15, the yaw command signal generator is now determined. The yaw command signal generator 151 is identical to the pitch command signal generator 153, with the exception that the yaw CSG 151 also includes a yaw control voltage oscillator (VCO) 196 connected to the output terminal of the yaw output amplifier 195. The yaw CSG 151 also includes a pitch voltage controlled oscillator (VCO) 197 which receives the pitch output signal from the pitch output amplifier 185. The output terminal of the pitch VCO 197 and the output terminal of the yaw VCO 196 are connected to an amplifier 198. The amplifier 198 is in turn coupled to the transmitter 27. The pitch output signal to the pitch VCO 197 frequency modulates the voltage control oscillator and provides a square wave push/pull output control signal to the transmitter 27. The yaw VCO 196 is also frequency modulated by its input signal and provides a square wave push/pull output to the amplifier 198.

It should be apparent from the foregoing that the present invention provides an accurate sight for generating missile guidance commands. It should also be apparent that the relative bore sight between the visual and IR waves in object space is not affected by a shift of the optical elements relative to one another. Accurate bore sighting between the IR and visual waves is maintained by mounting the optics in a rigid housing such as stainless steel. For example, translation of the objective lens 30 and the eyepiece 35 does not affect boresight since an image of the target with the reticle 34 superimposed on the target is relayed to the eye and the relative position of the reticle and target remain unaltered.

Although the present invention has been shown and described with reference to particular embodiments, nevertheless, various changes and modifications obvious to one skilled in the art to which this invention pertains are deemed to lie within the purview of the invention.

What is claimed is:

1. A optical system utilizing first and second waves, comprising:

lens means for receiving said first and second waves;

means optically coupled to said lens means for directing said first and second waves in first and second directions, respectively;

viewing means optically coupled to said wave directing means for receiving said first wave and establishing a line of sight;

rotating retrodirective reflector means having an axis of rotation being optically coupled to said wave directing means for receiving said second wave and reflecting an image in a nutating fashion over a first plane, the centroid of said nutating image deviating from the axis of rotation of said retrodirective reflector means in proportion to the angular displacement of said second wave from said line of sight of said first wave; and rotating prism means optically coupled to said rotating retrodirective reflector means for passing a second image and causing said second image to nutate over a second plane, the centroid of said nutating image deviating from said axis of rotation in proportion to the angular displacement of said second wave from said line of sight of said first wave.

2. An optical system according to claim 1 wherein said lens means comprise:

an objective lens for receiving visible and infrared waves; and image erecting means optically coupling said objective lens and said wave separating means.

3. An combined optical system according to claim 1 wherein said wave directing means comprise:

first reflecting means for reflecting said visible and infrared waves;

second reflecting means optically coupled to said first reflecting means for reflecting said visible wave in a first direction and for transmitting said infrared wave; and third reflecting means optically coupled to said second reflecting means for reflecting said infrared wave in a second direction.

4. A combined optics system according to claim 3 wherein said second reflecting means comprises:

a dichroic mirror.

5. An optical system according to claim 1 wherein said viewing means comprise:

field lens means optically coupled to said wave directing means;

reticle means optically coupled to said field lens means; and eyepiece means optically coupled to said field lens means.

6. An optical system according to claim 1 wherein said rotating retrodirective reflector means comprise:

a corner cube prism having a dichroic surface for reflecting a first infrared image and transmitting a second infrared image, said reflector further having an axis of rotation, a principal optical axis, and an axis of symmetry, said axis of rotation and said principal optical axis being coaxial and passing through said dichroic surface, said axis of rotation being displaced from said axis of symmetry, said displacement thereby causing said reflected image to nutate, said dichroic surface transmitting a second infrared image.

7. An optical system according to claim 6 wherein said corner cube prism further comprises:

wedge prism means coupled to said dichroic reflector surface of said corner cube reflector means for refracting said second infrared image passing therethrough and thereby causing said image to nutate.

8. An optics system according to claim 6 comprising:

first infrared detector means optically coupled to said corner cube reflector means for receiving said first infrared image and providing a signal in response to said image.

9. An optical system according to claim 7 comprising:

second infrared detector means optically coupled to said wedge prism for receiving said second infrared image and providing a signal in response to said image.

10. A combined optics system utilizing visible and infrared waves, comprising:

objective lens means for receiving said visible and infrared waves;

wave separating means optically coupled to said lens means for directing said visible and infrared waves in first and second directions, respectively;

viewing means optically coupled to said wave separating means for receiving said visible wave and establishing a line of sight;

rotating retrodirective reflector means optically coupled to said wave separating means for receiving said infrared wave and reflecting an infrared image in a nutating fashion over a first plane, the centroid of said nutating infrared image deviating from said axis of rotation in proportion to the angular displacement of said infrared wave from said line of sight of said visible wave; and rotating prism means coupled to said wave separating means for transmitting a second infrared image therethrough and causing said second infrared image to nutate over a second plane, the centroid of said nutating image deviating from said axis of rotation in proportion to the angular displacement of said infrared wave from said line of sight visible wave.

11. A optical system according to claim 10 wherein said wave separating means comprise:

first reflecting means for reflecting said visible and infrared waves;

second reflecting means optically coupled to said first reflecting means for reflecting said visible wave in a first direction and for transmitting said infrared wave; and third reflecting means optically coupled to said second reflecting means for reflecting said infrared wave in a second direction.

12. An optical system according to claim 11 wherein said second reflecting means comprises:

dichroic reflector means.

13. An optical system according to claim 10 wherein said viewing means comprise:

field lens means optically coupled to said wave separating means;

reticle means optically coupled to said field lens means; and eyepiece means optically coupled to said field lens means.

14. A combined optics system according to claim 10 wherein said rotating retrodirective reflector means comprise:

a corner cube reflector having a dichroic surface for reflecting a first infrared image and transmitting a second infrared image, said reflector further having an axis of rotation, a principal optical axis, and an axis of symmetry, said axis of rotation and said principal optical axis being coaxial and passing through said dichroic surface, said axis of rotation being displaced from said axis of symmetry, said displacement thereby causing said reflected image to nutate, said dichroic surface transmitting a second infrared image; and wedge prism means coupled to said dichroic reflector surface of said corner cube reflector means for refracting said second infrared image passing therethrough and thereby causing said image to nutate.

* * * * *